US006139371A

United States Patent [19]

Troutman et al.

[11] Patent Number: 6,139,371

[45] Date of Patent: Oct. 31, 2000

[54] COMMUNICATION CONNECTOR ASSEMBLY WITH CAPACITIVE CROSSTALK COMPENSATION

[75] Inventors: Dennis Lamar Troutman, Fishers; William Tracy Spitz, Indianapolis, both of Ind.

[73] Assignee: Lucent Technologies Inc., Murray Hill, N.J.

[21] Appl. No.: 09/421,569

[22] Filed: Oct. 20, 1999

[51] Int. Cl.[7] ..... H01R 24/00

[52] U.S. Cl. ..... 439/676; 439/941

[58] Field of Search ..... 439/676, 941

[56] References Cited

U.S. PATENT DOCUMENTS 5,547,405 8/1996 Pinney .
5,626,497 5/1997 Bouchan et al. ..... 439/941
5,791,943 8/1998 Lo .

*Primary Examiner*—Paula Bradley
*Assistant Examiner*—Tho D. Ta
*Attorney, Agent, or Firm*—Law Office of Leo Zucker

[57] ABSTRACT

A communication connector assembly has a base support, and at least first and second pairs of terminal contact wires with base portions mounted on the base support. The free end portions of the contact wires define a zone of contact within which electrical connections are established with a mating connector, and each pair of contact wires defines a different signal path in the connector assembly. The first and the second pair of contact wires have corresponding leading portions extending from the free end portions, to a side of the zone of contact opposite from the base portions. A leading portion of a contact wire of the first pair, and a leading portion of a contact wire of the second pair, are constructed and arranged for capacitively coupling to one another thus conveying capacitive crosstalk compensation to the zone of contact where offending crosstalk is introduced by a mated connector.

12 Claims, 5 Drawing Sheets

COMMUNICATION CONNECTOR ASSEMBLY WITH CAPACITIVE CROSSTALK COMPENSATION

CROSS-REFERENCE TO RELATED APPLICATION

U.S. Pat. application No. 09/428,752 filed Oct. 28, 1999, and entitled "Capacitive Cross-Talk Compensation Arrangement for a Communication Connector".

BACKGROUND OF THE INVENTION

1. Field of the Invention

This invention relates to communication or electrical connectors featuring capacitive compensation to suppress or to compensate for crosstalk.

2. Discussion of the Known Art

There is a need for a durable, high-frequency communication connector that suppresses or compensates for crosstalk produced among different signal paths within the connector. As defined herein, crosstalk results when signals conducted over a first path, e.g., a pair of terminal contact wires associated with a communication connector, are partly transferred by electromagnetic coupling into a second path, e.g., another pair of terminal contact wires in the same connector. The transferred signals define "crosstalk" in the second signal path, and this crosstalk degrades any signals that are being routed over the second path.

For example, an industry type RJ-45 communication connector typically includes four pairs of terminal wires defining four different signal paths. In the conventional RJ-45 plug and jack connectors, all four pairs of terminal wires extend closely parallel to one another over the length of the connectors. Thus, crosstalk is induced among different pairs of terminal wires, particularly in mated plug and jack combinations, and the amplitude of the crosstalk increases as the coupled signal frequencies or data rates increase.

Applicable industry standards for rating crosstalk performance of communication connectors, do so in terms of near-end crosstalk or "NEXT". Further, NEXT ratings are typically specified for mated plug and jack combinations, wherein the input terminals of the plug connector are used as a reference plane. Communication links using unshielded twisted pairs (UTP) of copper wire are now expected to support data rates up to not only 100 MHz or industry standard "Category 5" performance, but to meet proposed "Category 6" levels which call for at least 46 dB crosstalk loss at 250 MHz.

Crosstalk compensation circuitry may be provided on or within layers of a printed wire board, to which spring terminal contact wires of a communication jack are connected within a jack housing. See U.S. patent application No. 08/923,741 filed Sep. 29, 1997, now U.S. Pat. No. 5,997,358, and assigned to the assignee of the present application and invention. All relevant portions of the '741 application are incorporated by reference herein. See also U.S. Pat. No. 5,299,956 (Apr. 5, 1994).

U.S. patent application No. 09/327,882 filed Jun. 8, 1999, and assigned to the assignee of the present application and invention, discloses an enhanced communication connector assembly with crosstalk compensation. A number of terminal contact wires have base portions supported on a wire board, with free end portions opposite the base portions for making electrical contact with a mating connector. A crosstalk compensating device is provided on the wire board, wherein the device is arranged to cooperate with sections of selected terminal contact wires to provide capacitive coupling between the selected contact wires. U.S. patent application No. 09/344,831 filed Jun. 25, 1999, and also assigned to the present assignee, relates to an assembly for capacitive crosstalk compensation in a communication connector, wherein electrodes of housed compensation capacitors are arranged to contact selected terminal contact wires inside a communication connector so as to provide capacitive coupling between the selected wires. All relevant portions of the mentioned '882 and '831 applications are incorporated by reference.

U.S. Pat. No. 5,547,405 (Aug. 20, 1996) relates to a crosstalk suppressing connector having first and second signal carrying pairs of elongated, laterally spaced contacts mounted in a housing. An intermediate portion of one contact of one pair is formed to overlie an intermediate portion of another contact of the other pair, with a dielectric between the overlying portions. The overlying portions of the contacts are formed relatively close to insulation displacement connector terminals provided at one end of the contacts, and remote from the tail ends of the contacts where connections with a mating plug connector are established.

While capacitive crosstalk suppression or compensation is desirable since it can be applied or injected over a relatively short length of contact wires within a connector, the point at which such compensation is introduced ideally should be as close as possible to the source of the offending crosstalk, e.g., a mating plug.

SUMMARY OF THE INVENTION

According to the invention, a communication connector assembly includes a base support, and at least a first and a second pair of terminal contact wires having base portions mounted on the base support. Free end portions of the contact wires, opposite the base portions, define a zone of contact for establishing electrical connections with a mating connector, and each pair of contact wires defines a different signal path in the connector assembly. The contact wires of the first and the second pair of contact wires have corresponding leading portions extending from their free end portions, at a side of the zone of contact opposite from the base portions. A first leading portion of a contact wire of the first pair, and a second leading portion of a contact wire of the second pair, are dimensioned and arranged for capacitive coupling to one another to produce capacitive crosstalk compensation substantially at the zone of contact, when the mating connector operatively engages the terminal contact wires of the assembly.

For a better understanding of the invention, reference is made to the following description taken in conjunction with the accompanying drawing and the appended claims.

DETAILED DESCRIPTION OF THE INVENTION

Figure 1:
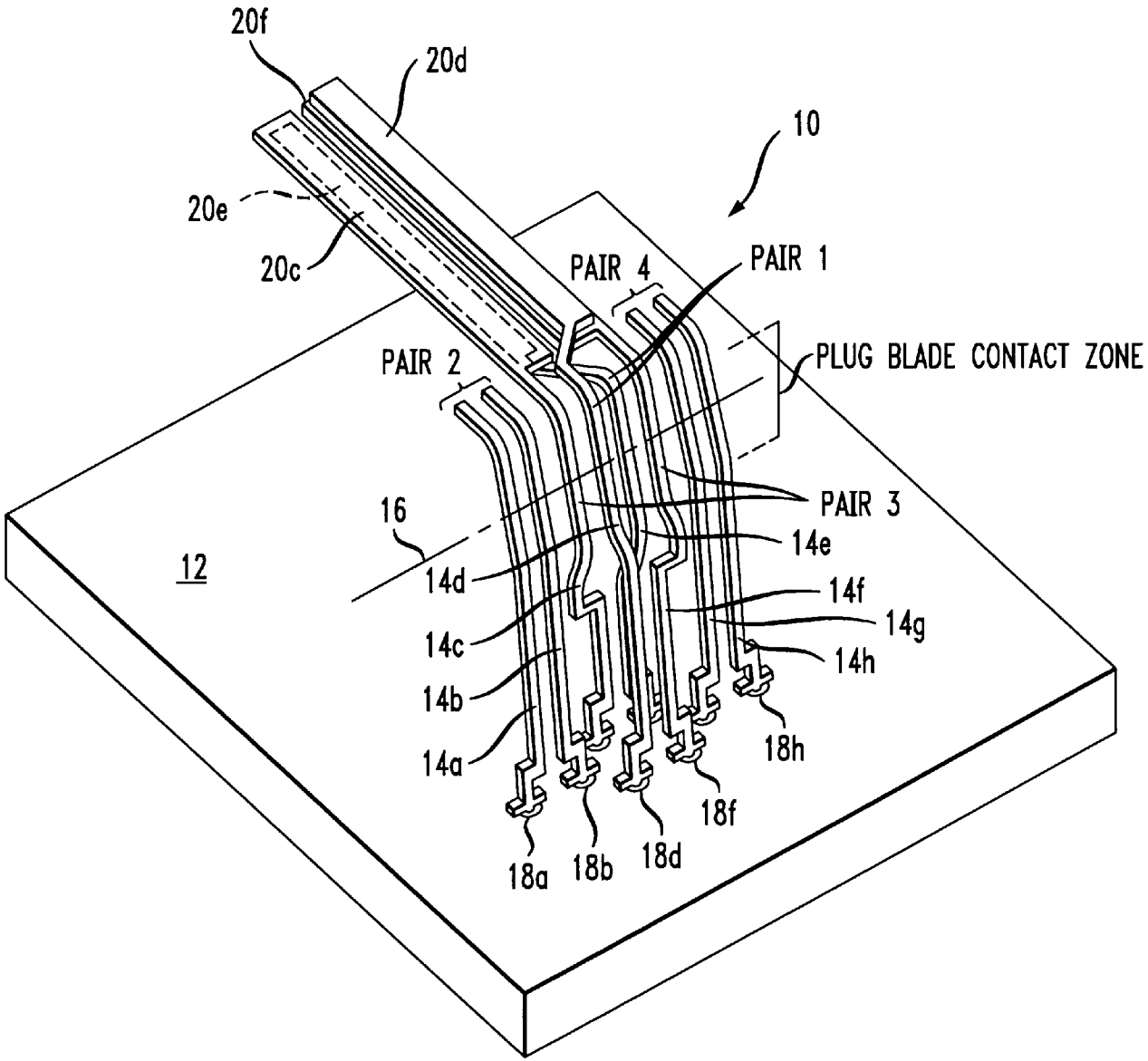
FIG. 1 is a perspective view of a first embodiment of a communication connector assembly with capacitive crosstalk compensation.

FIG. 1 is a perspective view of a first embodiment of a communication connector assembly 10, wherein capacitive crosstalk compensation is introduced at a region or zone about a line of contact 16 when the assembly 10 engages a mating connector, as described below in relation to FIG. 3. The assembly 10 includes a base support 12, and pairs of elongated terminal contact wires 14*a*–14*h* having base portions mounted in plated terminal openings 18*a*–18*h* in the base support 12. In the illustrated embodiment, the base portions of the terminal contact wires 14*a*–14*h* project generally normal to the surface of the base support 12, as seen in the side views of FIGS. 2 and 3. The terminal contact wires have contact portions connecting between the base portions and the free end portions, which define the line of contact 16 about which electrical connections are established with the mating connector.

The terminal contact wires 14*a*–14*h* may be formed of a copper alloy such as beryllium copper, spring-tempered phosphor bronze, or the like. A typical cross-section for the contact wires is approximately 0.015 inches wide (along the direction of the line of contact 16), and 0.010 inches thick. The base support 12 may comprise a single or a multi-layer dielectric substrate. Also, the support 12 may incorporate electrical circuit components and devices arranged to compensate for or reduced connector-induced crosstalk. Such devices may include wire traces printed on or within layers of the base support 12, as disclosed in the mentioned '741 application. Crosstalk compensation provided by the base support 12 may be in addition to an initial stage of capacitive crosstalk compensation provided by the terminal contact wires, as explained below. The base portions of the terminal contact wires 14*a*–14*h* may be soldered or press-fit in the terminal openings 18*a*–18*h* in the base support 12, thus connecting the contact wires with corresponding conductive paths on or within the support.

In the following disclosure, different pairs of the terminal contact wires 14*a*–14*h* are numbered and identified as below, with reference to FIG. 1. Each pair defines a different signal path within the connector assembly 10.

| PAIR NO. | CONTACT WIRES |
|---|---|
| 1 | 14d, 14e |
| 2 | 14a, 14b |
| 3 | 14c, 14f |
| 4 | 14g, 14h |

Figure 2:
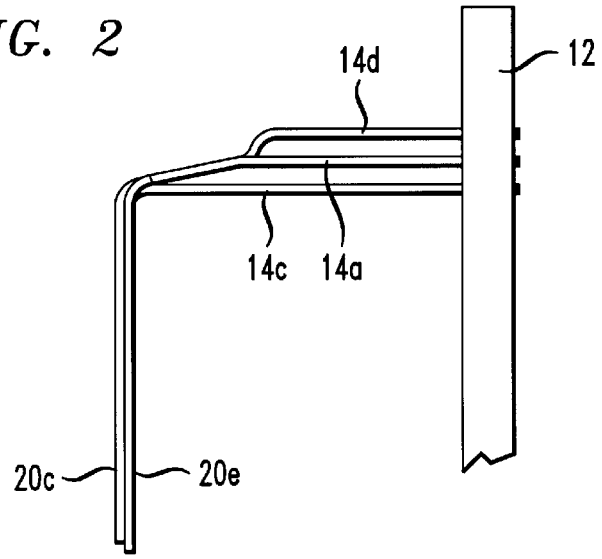
FIG. 2 is a side view of the connector assembly as seen from the left in FIG. 1.
Figure 3:
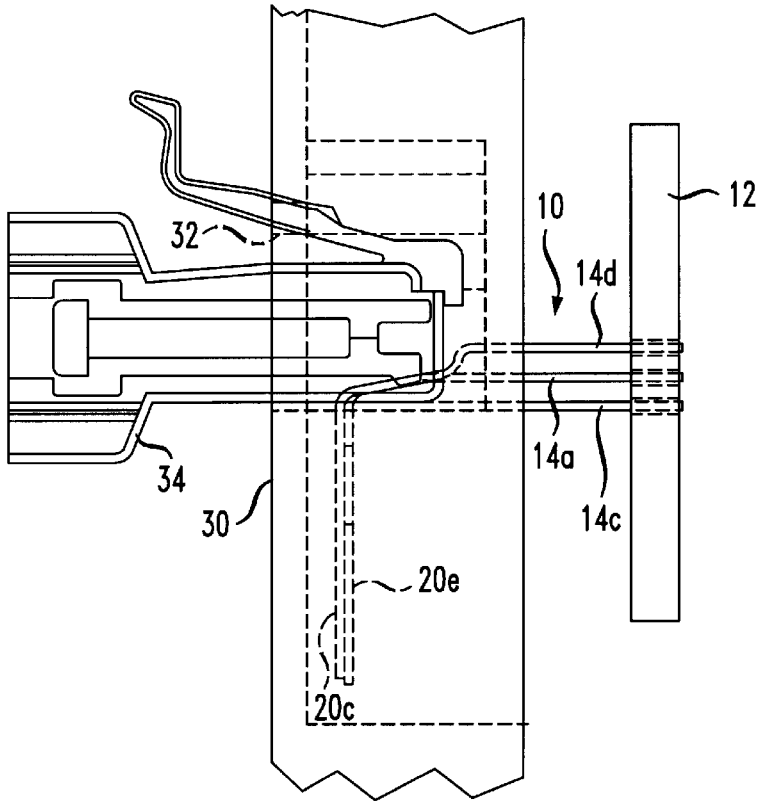
FIG. 3 is a side view of the connector assembly as in FIG. 2, when installed behind a panel and engaged in electrical contact with a mating plug connector.

In the embodiment of FIGS. 1–3, terminal contact wires 14*d* and 14*e* of pair 1, and contact wires 14*c* and 14*f* of pair 3, have corresponding leading portions 20*d*, 20*e*; and 20*c*, 20*f*, which leading portions extend from the free end portions of the contact wires at a side of the line of contact 16 that is opposite from the base portions of the contact wires and the base support 12. The leading portions 20*c*–20*f* of the terminal contact wires are in the form of elongated, generally rectangular parallel capacitor plates, each having a thickness of an associated terminal contact wire (e.g., 0.010 inches), and an area determined by the value of capacitive compensation coupling to be produced between one leading portion of one contact wire of one pair, and another leading portion of another contact wire of the other pair. Capacitive compensation coupling produced by the leading portions 20*d*, 20*e*; and 20*c*, 20*f*, is effectively conveyed to the line of contact 16 of the pair 1 and the pair 3 contact wires when their free end portions engage a mating plug connector. That is, the compensation coupling is provided at the point where offending crosstalk is being introduced to the assembly 10 by a mating connector.

In the embodiment of FIG. 1, the length and the width of leading portion 20*c*, are larger than the length and width of leading portion 20*e*. Likewise, the length and the width of portion 20*f*, are larger than the length and width of portion 20*d*.

Thus, precise alignment between overlying leading portions of the contact wires is not required, provided the portion having the smaller area is aligned entirely within the perimeter of the larger area portion. A relatively thin, insulative dielectric material such as, e.g., Teflon or Mylar with a thickness of, e.g., 0.010 inches, is sandwiched between the overlying leading portions. The dielectric material should have a breakdown voltage rating meeting industry standards, e.g., 1000 volts. The overlying leading portions of the contact wires with the dielectric between them should produce a capacitance value typically in the order of about 1.0 picofarads. Also, a surrounding plastics or other insulative material (not shown) may hold the leading portions and the dielectric fixed, while permitting them to move as a unit when the associated contact wires are deflected at the line of contact 16 by a mating connector. All of the leading portions 20*c*–20*f* of the terminal contact wires may be formed integrally as part of a lead frame structure from which the terminal contact wires 14*a*–14*h* are formed (e.g., by stamping) at the time of manufacture.

FIG. 3 is a side view of the connector assembly in FIG. 1, installed behind a panel 30 having an opening 32 for receiving a plug connector 34. The base support 12 of the communication connector assembly 10 is secured behind the panel 30, so that the free end portions of the terminal contact wires 14*a*–14*h* will engage and make electrical contact with corresponding contact wires of the mating plug connector 34 about the line of contact 16 in FIG. 1.

When operatively engaged with the plug connector 34 in FIG. 3, the connector assembly 10 produces capacitive crosstalk compensation coupling among contact wire pairs 1 and 3, by capacitively coupling contact wire 14*c* of pair 3 with contact wire 14*e* of pair 1; and coupling contact wire 14*f* of pair 3 with contact wire 14*d* of pair 1. This capacitive crosstalk compensation is introduced substantially at the line of contact 16 with the source of crosstalk (i.e., plug connector 34), so as to create an initial stage of capacitive crosstalk compensation. Because such compensation is introduced to the contact wires at the position of the plug connector 34, any additional compensation, whether capacitive or inductive, may be introduced over lengths of the terminal contact wires beyond the line of contact 16 toward the base support 12. Accordingly, any need for additional crosstalk compensation by way of circuits or devices on or within the base support 12, may be significantly reduced or eliminated altogether.

Figure 4:
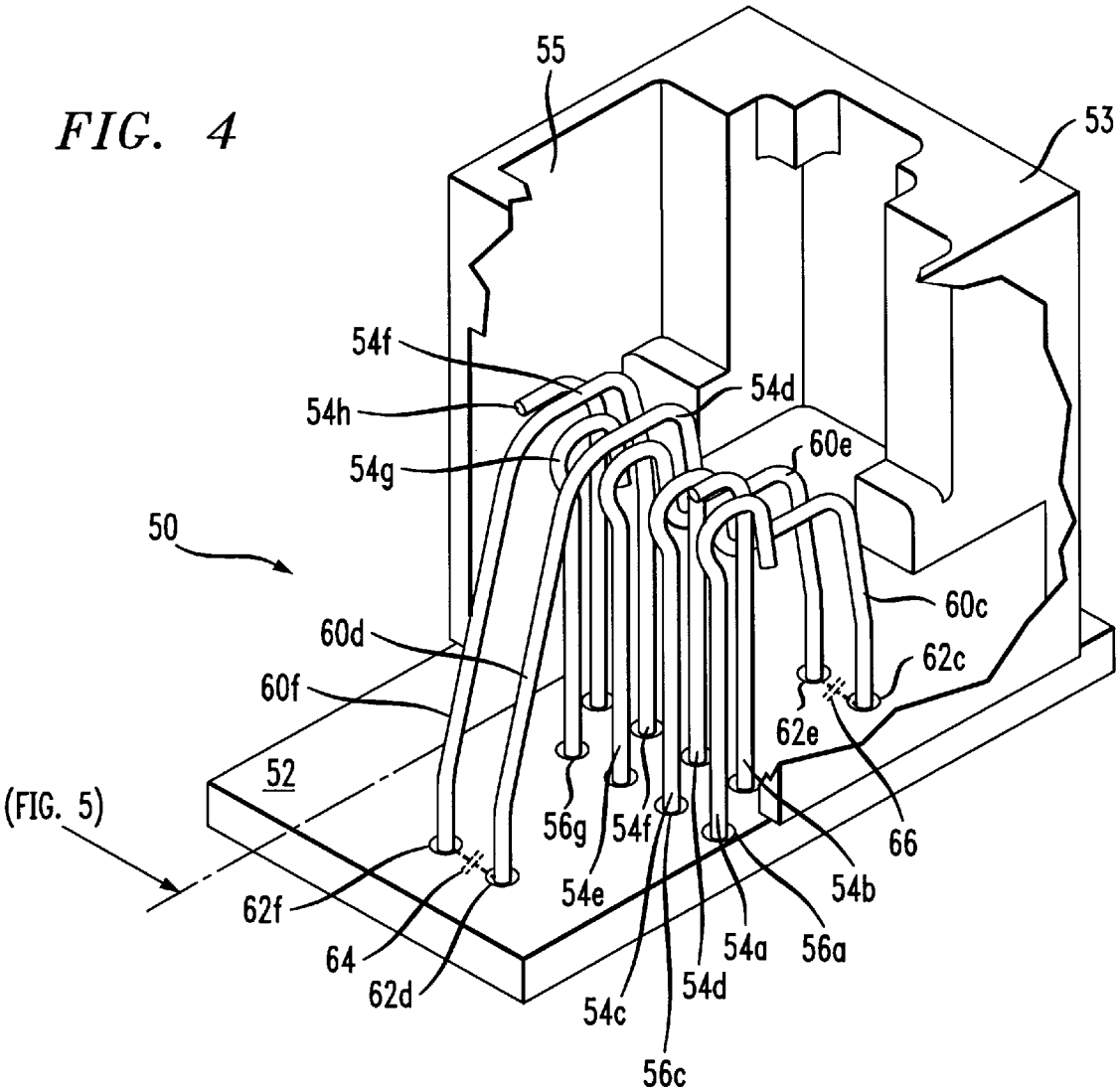
FIG. 4 is a perspective view of a second embodiment of a communication connector assembly with capacitive crosstalk compensation.

FIG. 4 is a perspective view of a second embodiment of a communication connector assembly 50 with crosstalk compensation. The assembly 50 includes a base support 52 that may be in the form of, for example, a single or a multi-layer dielectric substrate. Pairs of terminal contact wires, for example, contact wires 54*a*–54*h*, have associated base portions that may be soldered or press-fit into plated terminal openings 56*a*–56*h* formed through the base support 52, to connect the contact wires with corresponding conductive paths on or within the base support. In the illustrated embodiment, the base portions of the terminal contact wires 54*a*–54*h* project in a generally normal direction with respect to the top surface of the base support 52.

The terminal contact wires 54*a*–54*h* may be formed of a copper alloy such as beryllium copper, spring-tempered phosphor bronze, or the like. A typical cross-section for the contact wires 54*a*–54*h* is approximately 0.015 inches wide by 0.010 inches thick. The base support 12 may incorporate electrical circuit components and devices arranged to compensate for or to reduce connector-induced crosstalk. Such devices can include wire traces printed on or within layers of the base support 12, as disclosed in the mentioned '741 application. Crosstalk compensation provided by the base support 52 may be in addition to an initial stage of capacitive crosstalk compensation provided by the terminal contact wires, as explained below.

Figure 5:
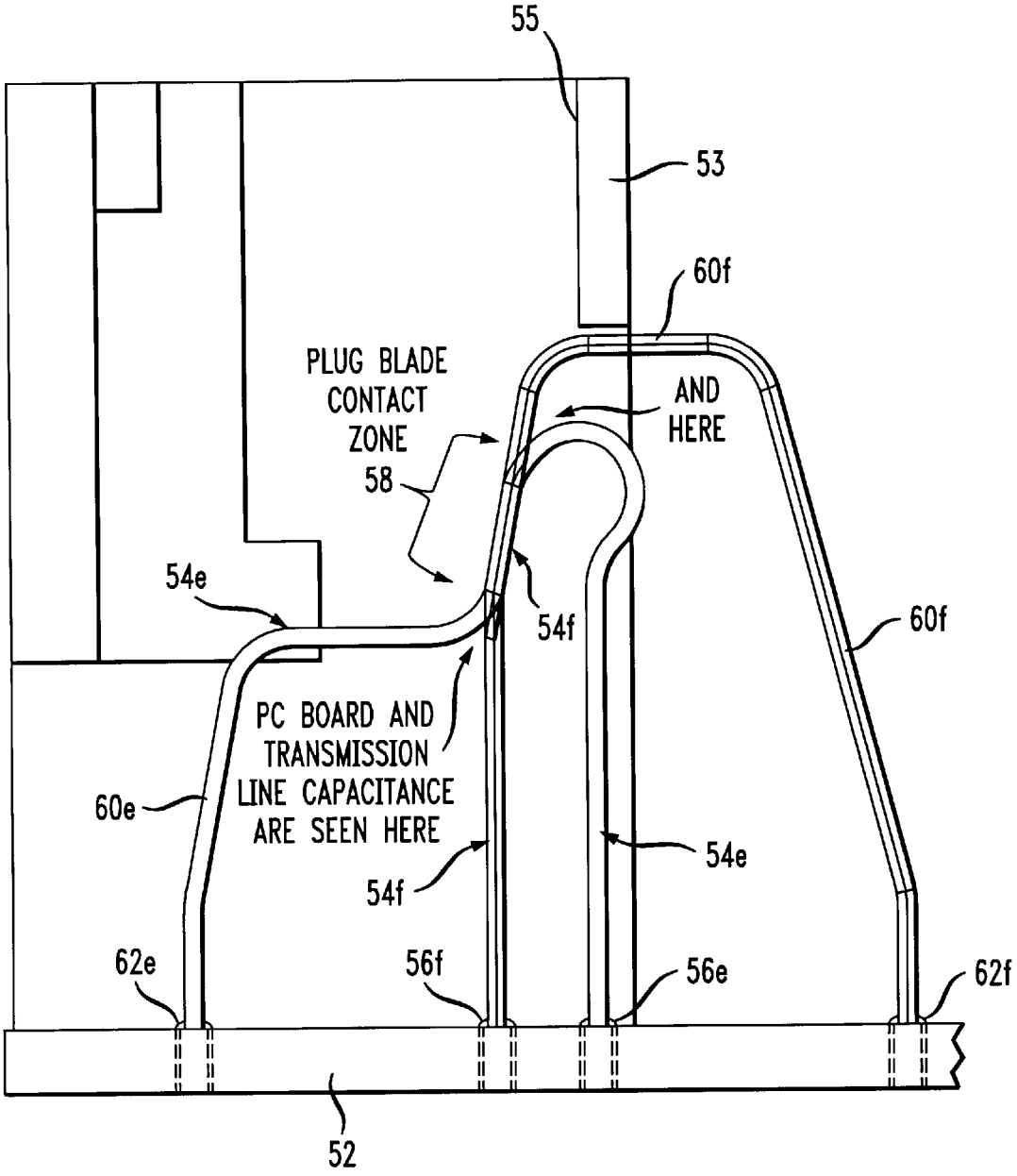
FIG. 5 is a side view of the connector assembly as seen from the rear in FIG. 4.
Figure 6:
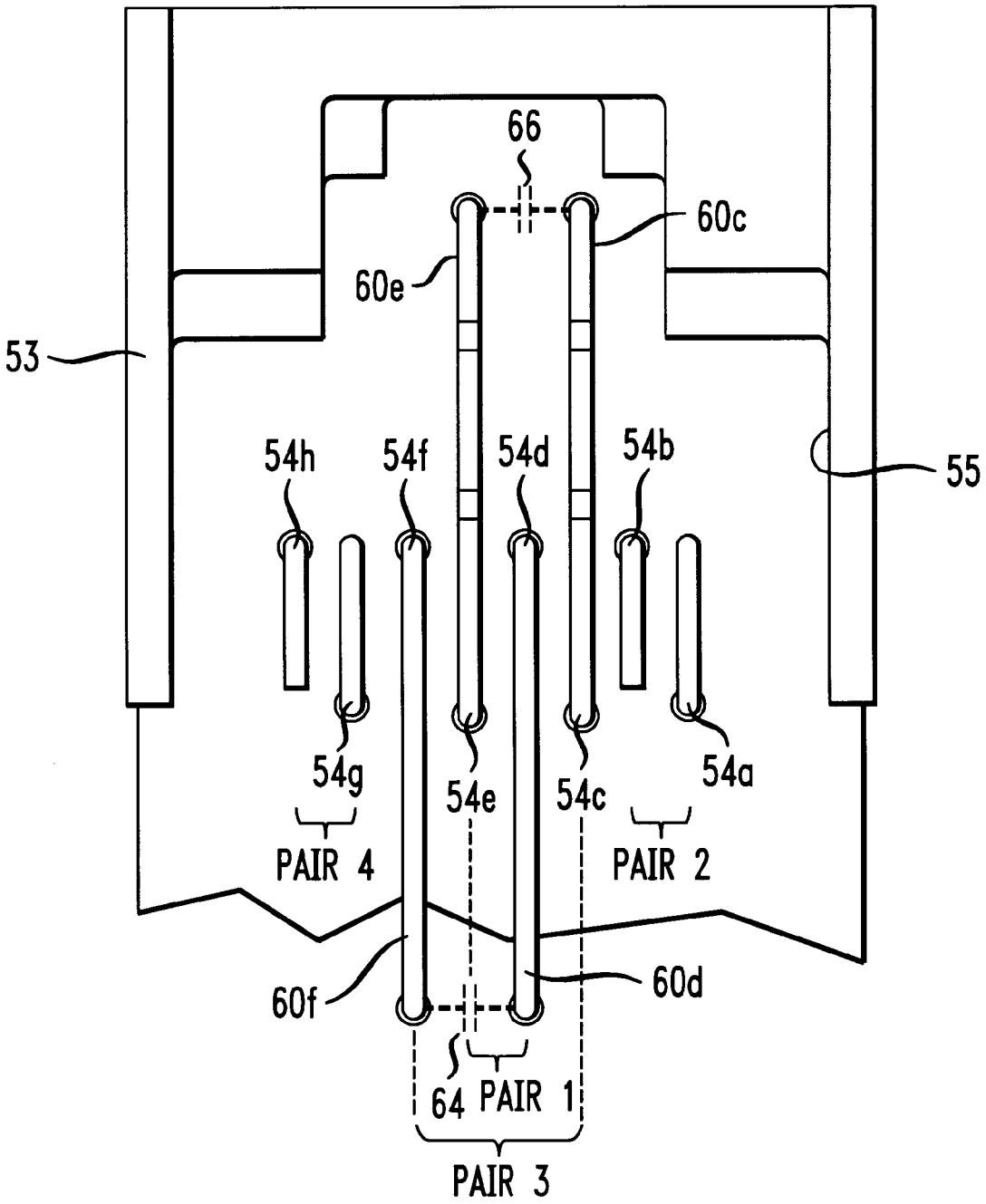
FIG. 6 is a top view of the connector assembly in FIG. 4.

Portions of the terminal contact wires 54*a*–54*h* define a zone of contact 58 for establishing electrical connections with terminals of a mating connector, as identified in FIG. 5. In the following disclosure, different pairs of the terminal contact wires 54*a*–54*h* are numbered and identified as below, with reference to FIG. 6. Each pair defines a different signal path within the connector assembly 50.

| PAIR NO. | CONTACT WIRES |
|---|---|
| 1 | 54d, 54e |
| 2 | 54a, 54b |
| 3 | 54c, 54f |
| 4 | 54g, 54h |

A leading portion 60*d* of terminal contact wire 54*d* of contact wire pair 1, and a leading portion 60*f* of terminal contact wire 54*f* of pair 3, extend beyond the zone of contact 58 and together define parallel loops that terminate in corresponding terminal openings 62*d*, 62*f*, in the base support 52. Further, a leading portion 60*c* of terminal contact wire 54*c* of pair 3, extends beyond the zone of contact 58 together with another leading portion 60*e* of contact wire 54*e* of pair 1. The leading portions 60*c*, 60*e*, also define parallel loops that terminate in corresponding terminal openings 62*c*, 62*e*, in the base support 52.

A determined compensation capacitance element 64 is connected between the terminals 62*d* and 62*f* in the base support 52. Further, a determined compensation capacitance element 66 is connected between the terminals 62*c*, 62*e*, in the base support 52. Capacitive crosstalk compensation is thus conveyed to the zone of contact 58 from the capacitance elements 64, 66, via the leading portions 60*d*, and 60*f*; and 60*c*, and 60*e*, for the associated terminal contact wires of pairs 1 and 3. The parallel leading portions 60*d*, and 60*f*; and 60*c*, and 60*e*, thus may be viewed as open-circuited transmission lines having electrically short lengths and acting to produce capacitive compensation coupling in an amount determined by the capacitance elements 64, 66, in the base support 12. An important feature of the connector assembly 50, therefore, is that it allows flexibility for adjusting the value of capacitive crosstalk compensation introduced at the zone of contact 58, for example, by merely altering circuit board artwork in the base support 52 which artwork determines the values of the elements 64, 66.

Like the communication connector assembly 10 of FIGS. 1–3, the assembly 50 achieves a first stage of crosstalk compensation where it is most beneficial, i.e., at a location where the offending crosstalk is being introduced. Remaining portions of the terminal contact wires 54*a*–54*h* beyond the zone of contact 58 toward the base support 52, remain available for providing a second stage of crosstalk compensation, and any need for additional compensation devices on or within the base support 52 is greatly reduced or eliminated altogether.

While the foregoing description represents preferred embodiments, it will be obvious to those skilled in the art that various changes and modifications may be made, without departing from the spirit and scope of the invention pointed out by the following claims.

We claim:

1. A communication connector assembly, comprising:

a base support;

a plurality of terminal contact wires having base portions mounted on the base support;

said plurality of terminal contact wires having free end portions and contact portions connecting between the base portions and the free end portions, at least a first and a second pair of terminal contact wires having the free end portions extending longer than the free ends of the remaining of terminal contact wires to define leading portions, the contact portions for defining a zone of contact for establishing electrical connections with a mating connector, and each pair of said first and second pairs of terminal contact wires defines a different signal path;

the corresponding leading portions extending from their contact portions, at a side of the zone of contact opposite from the base portions of the terminal contact wires;

wherein one of the leading portions of the first pair of terminal contact wires, and one of the leading portions of the second pair of terminal contact wires, are dimensioned and arranged for capacitively coupling to one another to produce capacitive crosstalk compensation substantially at the zone of contact when the mating connector operatively engages the terminal contact wires.

2. A communication connector assembly according to claim 1, wherein the leading portions are formed integrally with the corresponding first and second pairs of terminal contact wires.

3. A communication connector assembly according to claim 1, wherein the base support includes one or more stages of crosstalk compensation in addition to the compensation provided by the leading portions of the first and second pairs of terminal contact wires.

4. A communication connector assembly according to claim 1, wherein said leading portions are overlying leading portions and in the form of parallel capacitor plates.

5. A communication connector assembly according to claim 4, including a dielectric material sandwiched between the plates of said one of the leading portions of the first pair of terminal contact wires and said one of the leading portions of the second pair of terminal contact wires.

6. A communication connector assembly according to claim 4, wherein the capacitor plate of said one of the leading portions of the first pair of terminal contact wires has an area larger than that of the overlying capacitor plate of said one of the leading portions of the second pair of terminal contact wires, so that the capacitor plate of said one of the leading portions of the first pair of terminal contact wires is aligned within the perimeter of the capacitor plate of said one of the leading portions of the second pair of terminal contact wires.

7. A communication connector arrangement comprising:

a panel having an opening for receiving a plug connector;

a base support fixed behind the panel;

a plurality of terminal contact wires having base portions mounted on the base support;

said plurality of terminal contact wires having free end portions and contact portions connecting between the base portions and the free end portions, at least a first and a second pair of terminal contact wires having the free end portions extending longer than the free ends of the remaining of terminal contact wires to define leading portions, the contact portions for defining a zone of contact for establishing electrical connections with a plug connector, and each pair of said first and second pairs of terminal contact wires defines a different signal path;

the base support being oriented with respect to the panel so that the contact portions of the terminal contact wires engage and establish electrical contact with the plug connector when the plug connector is inserted in the opening in the panel;

the corresponding leading portions extending from their contact portions, at a side of the zone of contact opposite from the base portions of the terminal contact wires;

wherein one of the leading portions of the first pair of terminal contact wires, and one of the leading portions of the second pair of terminal contact wires, are dimensioned and arranged for capacitively coupling to one another to produce capacitive crosstalk compensation substantially at the zone of contact when the mating connector operatively engages the terminal contact wires.

8. A communication connector assembly according to claim 7, wherein the leading portions are formed integrally with the corresponding first and second pairs of terminal contact wires.

9. A communication connector assembly according to claim 7, wherein the base support includes one or more stages of crosstalk compensation in addition to the compensation provided by the leading portions of the first and second pairs of terminal contact wires.

10. A communication connector arrangement according to claim 7, wherein said leading portions are overlying leading portions and in the form of parallel capacitor plates.

11. A communication connector arrangement according to claim 10, including a dielectric material sandwiched between the plates of said one of the leading portions of the first pair of terminal contact wires and said one of the leading portions of the second pair of terminal contact wires.

12. A communication connector assembly according to claim 10, wherein the capacitor plate of said one of the leading portions of the first pair of terminal contact wires has an area larger than that of the overlying capacitor plate of said one of the leading portions of the second pair of terminal contact wires, so that the capacitor plate of said one of the leading portions of the first pair of terminal contact wires is aligned within the perimeter of the capacitor plate of said one of the leading portions of the second pair of terminal contact wires.

* * * * *